US006344709B1

(12) United States Patent
Uchikawa

(10) Patent No.: US 6,344,709 B1
(45) Date of Patent: Feb. 5, 2002

(54) MICROWAVE ELECTRON GUN

(75) Inventor: Tatsuya Uchikawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/357,765

(22) Filed: Jul. 21, 1999

(30) Foreign Application Priority Data

Jul. 24, 1998 (JP) ..... 10-209660

(51) Int. Cl.[7] ..... H01J 3/02

(52) U.S. Cl. ..... 313/417; 313/441; 313/456; 313/451; 315/5.33; 315/3.5

(58) Field of Search ..... 313/456, 451, 313/417, 441, 444, 470, 292, 250; 315/5.33, 3.5

(56) References Cited

U.S. PATENT DOCUMENTS

| | | | | |
|---|---|---|---|---|
| 2,814,751 A | | 11/1957 | Murdock et al. | 313/247 |
| 3,979,634 A | | 9/1976 | Jaillet et al. | 315/3.5 |
| 4,376,257 A | * | 3/1983 | Miyazaki et al. | 313/417 |
| 5,534,747 A | * | 7/1996 | Carruthers | 313/456 |
| 5,629,582 A | * | 5/1997 | Dobbs | 313/456 |

FOREIGN PATENT DOCUMENTS

| | | |
|---|---|---|
| JP | 30-6211 | 10/1953 |
| JP | 56-28439 | 3/1981 |
| JP | 1-142147 | 9/1989 |
| JP | 02-5866 | 1/1990 |
| JP | 02-160400 | 6/1990 |
| JP | 4-215233 | 8/1992 |
| JP | 5-250998 | 9/1993 |
| JP | 9-115453 | 5/1997 |

* cited by examiner

*Primary Examiner*—Nimeshkumar D. Patel
*Assistant Examiner*—Karabi Guharay
(74) *Attorney, Agent, or Firm*—Sughrue Mion, PLLC

(57) ABSTRACT

An electron gun with a simple structure, wherein electrodes are extracted along the axis of the gun. The electron gun comprises first stepped metal cylinder 201 which is joined with cathode 200, second metal cylinder 202 which is joined with first stepped metal cylinder 201, metal plate 221 which is joined with second metal cylinder 202, insulating cylinder 220 which is joined with metal plate 221, third metal cylinder 260 which is joined with the outer surface of insulating cylinder 220, fourth metal cylinder 210 which is joined with third metal cylinder 260, stepped insulating cylinder 250 which is joined with fourth stepped metal cylinder 210, fifth metal cylinder 270 which is joined with stepped insulating cylinder 250. Fifth metal cylinder 270 is grounded. Cathode lead wire and heater lead wire are extracted from insulating cylinder 220, while anode lead wire is connected with metal cylinder 260.

6 Claims, 3 Drawing Sheets

MICROWAVE ELECTRON GUN

BACKGROUND OF THE INVENTION

1. Technical Field of the Invention

The present invention relates to an electron gun for microwave tubes such as traveling-wave tube (TWT) and Klystron.

2. Description of the Prior Art

Microwave tubes are used mainly as microwave amplifiers at earth stations and relay stations for microwave satellite communication. Recently, the microwave tubes are required to be small and light, as the earth stations and relay stations becomes compact and light in weight. Particularly, compact size and light in weight of the TWT for a repeater which is mounted in the satellite is of great importance.

A conventional hot cathode electron gun disclosed in JP 09115453 A, 1997 is shown in FIG. 4. As shown in FIG. 4, hot cathode 102 is joined with stepped metal cylinder 118 which is joined with another stepped metal cylinder 117 which is further joined with focus electrode cylinder 119. Cathode 111, anode 113, heater electrode 122 are insulated form one another by insulating cylinders 112 and 112', while cathode 111 is connected with focus electrode cylinder 119 and anode 113 is connected with a metal member consisted of metal cylinder 114 and anode electrode plate 115. Further, one end 120 of a heater lead wire is connected with heater electrode 120, while the other end 121 if the same is connected with metal cylinder 117. The electron gun as explained above is sealed be sealing metal 123 and is connected with a not-shown RF frequency circuit by sealing plate 116. Here, anode 113 is insulated from the not-shown RF circuit by using insulating cylinder 112".

Further, a conventional cold cathode electron gun also disclosed in the above-mentioned JP 09115453 A, 1997 is shown in FIG. 5. As shown in FIG. 5, cold cathode 1 is joined with metal member 2 through plate 21*a*. Further, metal member 2 goes through insulating cylinder 3 which is joined with stepped metal cylinder 9 which mounts focus electrode 8. Here, metal cylinder 9 is connected with a not-shown gate of cold cathode 1 by conductive wire 10, while insulating cylinder 3 is joined with insulating cylinder 4. Further, the not-shown gate is connected electrically with gate metal cylinder 7 by metallized layer 31*c*. Here, metallized layers 31*a* and 31*b* are used for obtaining electric connection at the connecting portion, respectively. The electron gun as explained above is contained in metal cylinder 5. Further, metal cylinder 5 and insulating cylinder 4 are joined with stepped metal cylinder 6.

However, the surrounding of the above-mentioned conventional hot electron guns must be furthermore insulated, because the insulating cylinders are stacked for the insulation of each electrode and high voltages are applied directly to the surrounding of the electron gun. Accordingly, insulating material must be fixed by using a jig of which diameter is greater than the surrounding.

On the contrary, it is not necessary to fix the insulating material around the external surrounding of the above-mentioned conventional cold cathode electron gun, because the surrounding is grounded electrically and each electrode is extracted along the axis of the electron gun. However, the above-mentioned conventional cold cathode electron gun has a disadvantage that its outer radius becomes great, due to the additional metal cylinder for obtaining electrical ground. Therefore, electron gun can not be made small and light.

Further, the structures of the above-mentioned hot and cold electron gun are so complex that it is difficult to manufacture them.

SUMMARY OF THE INVENTION

Therefore, an object of the present invention is to provide an electron gun, wherein its structure is simple and further electrodes can be extracted along its axis.

The hot cathode electron gun of the present invention comprises first stepped metal cylinder 201 which is joined with cathode 200, second metal cylinder 202 which is joined with first stepped metal cylinder 201, metal plate 221 which is joined with second metal cylinder 202, insulating cylinder 220 which is joined with metal plate 221, third metal cylinder 260 which is joined with the outer surface of insulating cylinder 220, fourth metal cylinder 210 which is joined with third metal cylinder 260, stepped insulating cylinder 250 which is joined with fourth stepped metal cylinder 210, and fifth metal cylinder 270 which is joined with stepped insulating cylinder 250.

In this electron gun, fifth metal cylinder 270 is grounded electrically. Further, cathode lead wire, anode lead wire, heater lead wire are extracted along the axis of the gun.

In place of the hot cathode, a cold cathode is also applicable, and cathode lead wire, anode lead wire, and gate lead wire are extracted along the axis of the gun.

In the electron gun of the present invention, an insulating cylinder is used as a vacuum envelope, and the electrodes are extracted along the gun axis.

According to the present invention, it is not necessary to insulate the surrounding of electron gun, because an insulating cylinder is used as a vacuum envelope and the electrodes are extracted along the axis of the electron gun. Therefore, the electron gun can be made small and light.

Further, the insulating cylinder as a vacuum envelope operates also as a jig for filling up insulating material around the high voltage terminals of the electrodes, because the terminals are positioned inside the insulating cylinder. Therefore, conventional jigs become needless. Accordingly, manufacturing processes of the electron gun are simplified.

PREFERRED EMBODIMENT OF THE INVENTION

Figure 1:
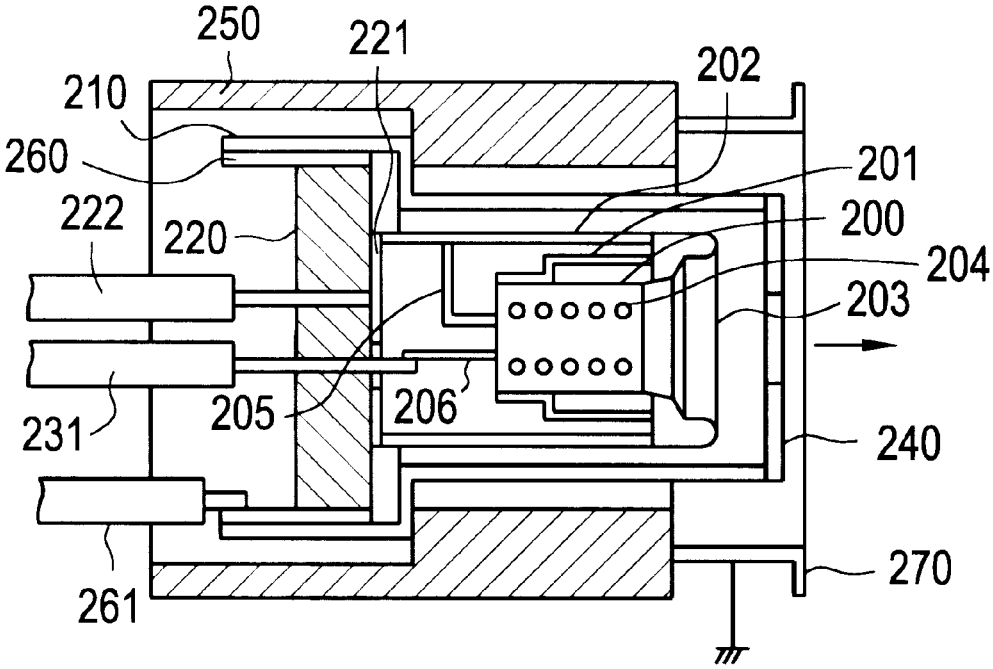
FIG. 1 is a cross sectional view of a hot cathode electron gun of the present invention.

In the following, the mode of embodiment of the present invention is explained, referring to the drawings.

FIG. 1 is a cross sectional view of a hot cathode electron gun of the present invention. As shown in FIG. 1, the hot cathode electron gun of the present invention comprises first stepped metal cylinder 201 which is joined with cathode 200, second metal cylinder 202 which is joined with first stepped metal cylinder 201, metal plate 221 which is joined with second metal cylinder 202, insulating cylinder 220 which is joined with metal plate 221, third metal cylinder 260 which is joined with the outer surface of insulating cylinder 220, fourth metal cylinder 210 which is joined with third metal cylinder 260, stepped insulating cylinder 250 which is joined with fourth stepped metal cylinder 210, and fifth metal cylinder 270 which is joined with stepped insulating cylinder 250. The above-mentioned electron gun of the present invention is connected with an RF circuit.

Cathode 200 is a hot cathode which is joined with stepped first metal cylinder 201 which is joined with second metal cylinder and Wehnelt electrode 203. Further, second metal electrode 202 is connected with first heater lead 205 of built-in heater 204 in cathode 200.

In the first paragraph of page 6, please delete that paragraph and replace it with the following:

Further metal plate 221 is joined with insulating cylinder 220. Metal plate 221 is also connected with cathode lead wire 222.

Second heater lead 206 of buit-in heater 204 in cathode 200 is connected with heater lead 231. Therefore, a through hole is formed in metal plate 221 in order to avoid contacting metal plate 221 with heater lead 231.

Anode 240 is joined with fourth stepped metal cylinder 210 which is sealed hermetically with the pier portion of insulating cylinder 250. Further, fourth stepped metal cylinder 210 is also sealed hermetically with third metal cylinder 260 which is joined with the inner side of insulating cylinder 220. Furthermore, anode lead wire 261 is connected with third metal cylinder 260.

Further, insulating cylinder 250 is connected with fifth metal cylinder 270 for the connection with the not-shown RF circuit. Fifth metal cylinder 270 is grounded electrically, while the electric potential of the outer surface of insulating cylinder 250 becomes equal to the ground potential, maintaining the insulation between the anode and the RF circuit.

Thus, in the hot cathode electron gun of the present invention, the electrodes are extracted along the axis of the electron gun.

Further, it is not necessary any more to insulating the surrounding of the electron gun, because the electric potential of the surrounding becomes the ground potential.

The external high voltage terminals should be insulated. In the electron gun of the present invention, insulating cylinder 220 is located inside insulating cylinder 205. Accordingly, insulating material can be filled up in the space made by insulating cylinder 250, insulating cylinder 220, and third metal cylinder 210.

The present invention can be applicable also to cold cathode electron gun.

Figure 2:
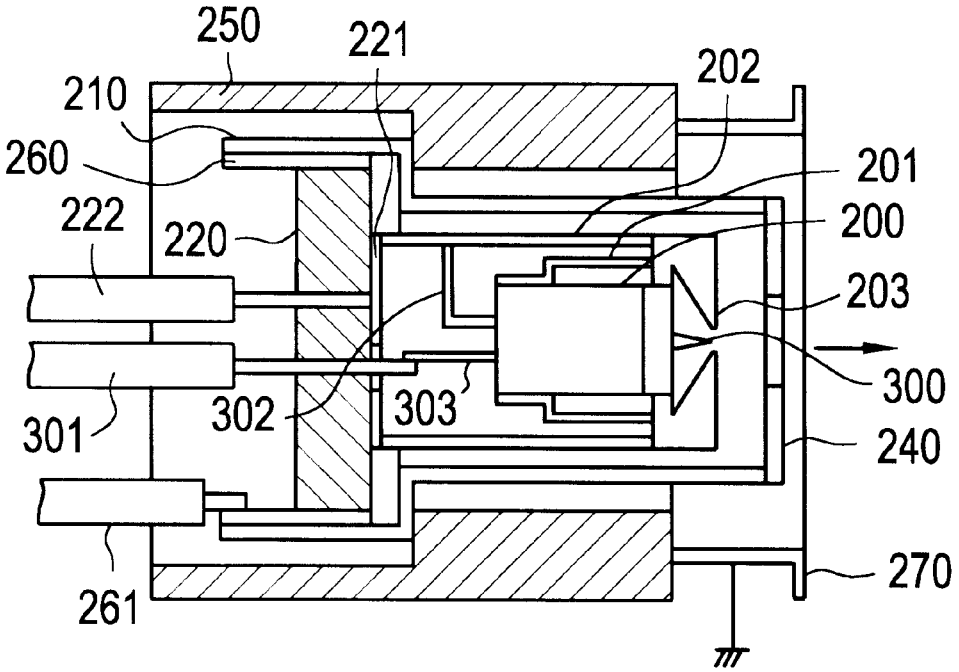
FIG. 2 is a cross sectional view of a cold cathode electron gun of the present invention.

FIG. 2 is a cross sectional view of a cold cathode electron gun of the present invention. As shown in FIG. 2, the cold cathode electron gun of the present invention emits electrons by field emission from filament emitter 300 connected with cathode 200 which is connected with cathode lead wire 222 through cathode lead 302. Anode 240 is connected with anode lead wire 261, while a not-shown gate is connected with gate lead wire 301 through gate lead 303. Here, the field emission portion is not limited to the filament emitter, but it can also be manufactured by semiconductor processes.

Figure 3:
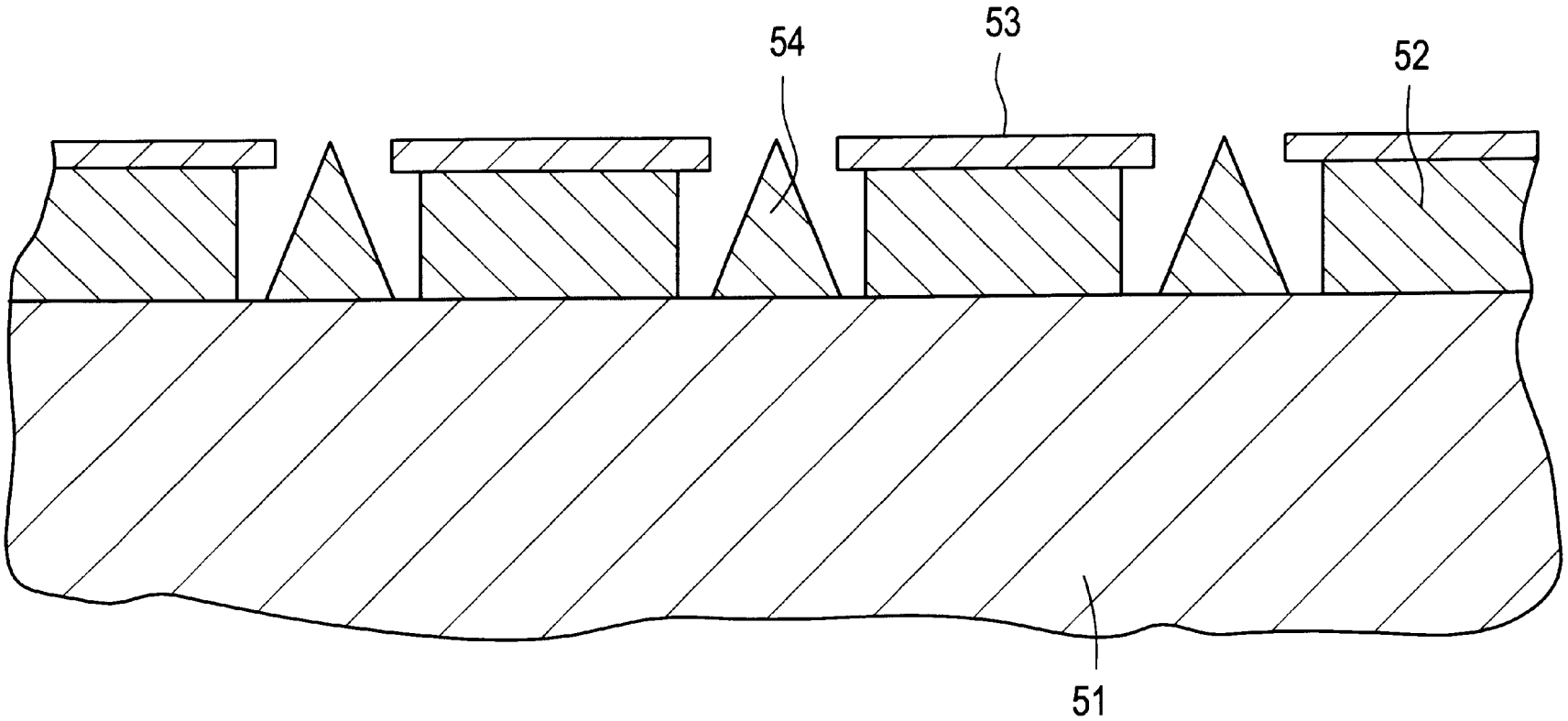
FIG. 3 is a cross sectional view of a cold cathode element formed on a Si substrate.
Figure 4:
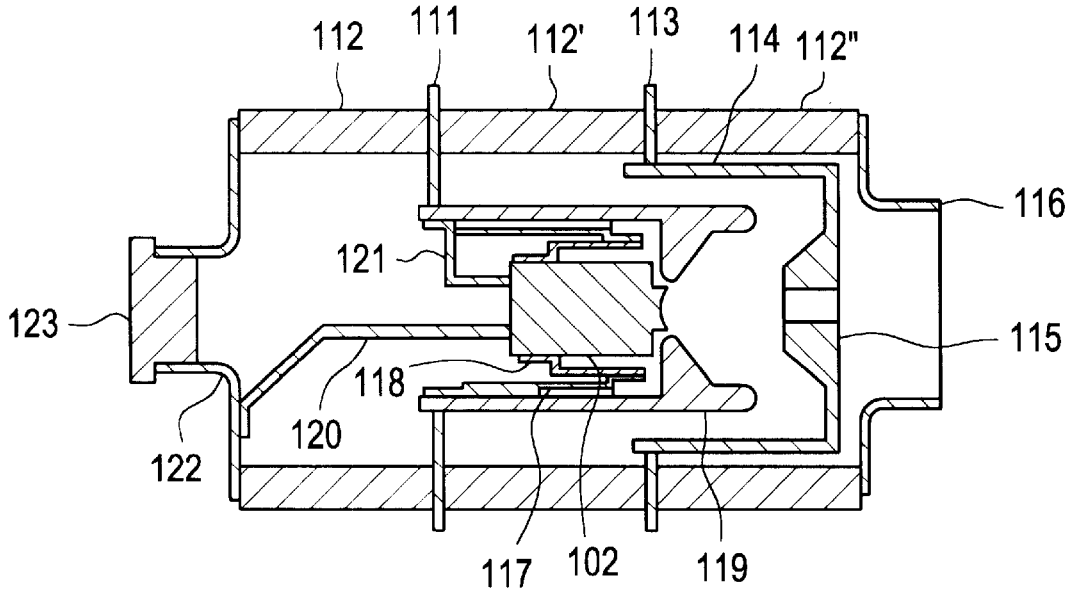
FIG. 4 PRIOR ART
FIG. 4 is a cross sectional view of a conventional hot cathode electron gun.
Figure 5:
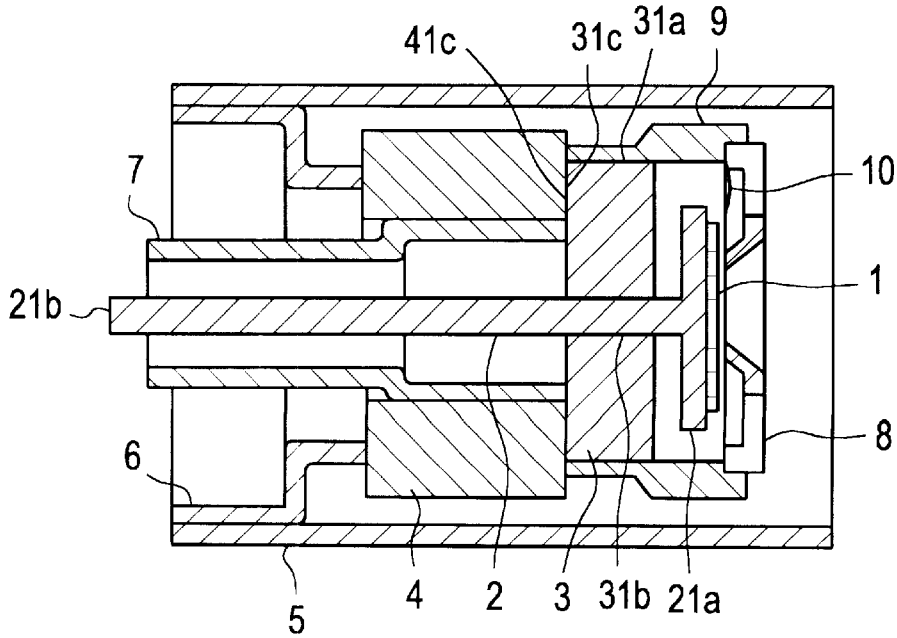
FIG. 5 PRIOR ART
FIG. 5 is a cross sectional view of a conventional cold cathode electron gun.

FIG. 3 is a cross sectional view of a field emission portion formed on a Si substrate. As shown in FIG. 3, insulating layer 52 and metal member 54 which emits electrons are formed on Si substrate 51. Further, gate electrode 53 is formed on insulating layer 52. Electrons are emitted from metal member 54 by applying a voltage between Si substrate 51 and gate electrode 53.

Although the present invention has been shown and described with respect to the best mode embodiment thereof, it should be understood by those skilled in the art that the foregoing and various other changes, omissions, and additions in the form and detail thereof may be made therein without departing from the spirit and scope of the present invention.

What is claimed is:

1. An electron gun having electrodes, which comprises:

a first stepped metal cylinder 201 which is joined with cathode 200;

a second metal cylinder 202 which is joined with said first stepped metal cylinder 201;

a metal plate 221 which is joined with said second metal cylinder 202;

an insulating cylinder 220 which is joined with said metal plate 221;

a third metal cylinder 260 which is joined with the outer surface of said insulating cylinder 220;

a fourth metal cylinder 210 which is joined with said third metal cylinder 260;

a stepped insulating cylinder 250 which is joined with said fourth stepped metal cylinder 210; and a fifth metal cylinder 270 which is joined with said stepped insulating cylinder 250;

wherein:

said cathode 200 is a hot cathode;

said fifth metal cylinder 270 is grounded electrically; and terminals for electrodes of said electron gun are extracted along the axis of said stepped insulating cylinder 250.

2. The electron gun according to claim 1, wherein said insulating cylinder 220, said fourth metal cylinder 210, and said third metal cylinder 260 are positioned inside said insulating cylinder 250.

3. The electron gun according to claim 2, wherein insulating material is filled up in the space formed by said insulating cylinder 250, said insulating cylinder 220, and said third metal cylinder.

4. An electron gun having electrodes, which comprises:

a first stepped metal cylinder 201 which is joined with cathode 200;

a second metal cylinder 202 which is joined with said first stepped metal cylinder 201;

a metal plate 221 which is joined with said second metal cylinder 202;

an insulating cylinder 220 which is joined with said metal plate 221;

a third metal cylinder 260 which is joined with the outer surface of said insulating cylinder 220;

a fourth metal cylinder 210 which is joined with said third metal cylinder 260;

a stepped insulating cylinder 250 which is joined with said fourth stepped metal cylinder 210; and a fifth metal cylinder 270 joined with said stepped insulating cylinder 250;

wherein:

said cathode 200 is a cold cathode;

said fifth metal cylinder 270 is grounded electrically; and terminals for electrodes of said electron gun are extracted along the axis of said stepped insulating cylinder 250.

5. The electron gun according to claim 4, wherein said insulating cylinder 220, said fourth metal cylinder 210, and said third metal cylinder 260 are positioned inside said insulating cylinder 250.

6. The electron gun according to claim 5, wherein insulating material is filled up in the space formed by said insulating cylinder 250, said insulating cylinder 220, and said third metal cylinder.

* * * * *